US005205555A

United States Patent [19]

Hamano

[11] Patent Number: 5,205,555

[45] Date of Patent: Apr. 27, 1993

[54] ELECTRONIC GAMING MACHINE

[75] Inventor: Masahiro Hamano, Osaka, Japan

[73] Assignee: Takasago Electric Industry Co., Ltd., Osaka, Japan

[21] Appl. No.: 874,494

[22] Filed: Apr. 27, 1992

[30] Foreign Application Priority Data

May 23, 1991 [JP] Japan ..... 3-149572
Jul. 11, 1991 [JP] Japan ..... 3-198778

[51] Int. Cl.[5] ..... G07F 17/34
[52] U.S. Cl. ..... 273/143 R
[58] Field of Search ..... 273/138 A, 143 R, 85 CP

[56] References Cited

U.S. PATENT DOCUMENTS 3,584,398 6/1971 Meyer et al. ..... 273/138 A
4,695,053 9/1987 Vazquez et al. ..... 273/143 R
4,721,307 1/1988 Okada ..... 273/143 R
4,836,546 6/1989 Dire et al. ..... 273/138 A

*Primary Examiner*—Benjamin H. Layno
*Attorney, Agent, or Firm*—Jordan and Hamburg

[57] ABSTRACT

The present invention relates to an electronic gaming machine, in which after a game is executed by betting playing mediums such as tokens, the number of playing mediums to be paid is determined in response to the result of game. The electronic gaming machine includes a plurality of reels, and when the reels stop, one of plural symbols printed around each reel is stopped on a stop line. On the reels, a numerical and a non-numerical symbol are indicated together, and when the reels stop, an internal control unit judges the kind of symbols stopped on the stop line and the content of the numerical values. When the symbols on the stop line are all associated with the numerical values, the control unit substitutes the numerical values into a predetermined operational equation to execute the operation, and thereby determines the number of tokens to be paid in response to the operation result. The numerical values stopped on the stop line and the operation result are displayed and the operation process and operation result are disclosed to the player.

8 Claims, 16 Drawing Sheets

| C | FIRST REEL | SECOND REEL | THIRD REEL | FOURTH REEL |
|---|---|---|---|---|
| 1 | 7 | 7 | 7 | 777 |
| 2 | — | — | — | B.BET |
| 3 | 1 | 1 | 3 | R |
| 4 | — | — | — | Y |
| 5 | — | 1 | — | B.BET |
| 6 | 1 | — | 1 | R |
| 7 | — | 5 | — | Y |
| 8 | 1 | — | — | B.BET |
| 9 | — | — | 7 | R |
| 10 | — | 3 | — | Y |
| 11 | 3 | — | 1 | B.BET |
| 12 | — | — | — | Y |
| 13 | 5 | 5 | 1 | G |
| 14 | — | — | — | B.BET |
| 15 | 1 | 3 | — | B |
| 16 | — | — | 5 | G |
| 17 | — | — | — | B.BET |
| 18 | 1 | 1 | 1 | B |
| 19 | — | — | — | G |
| 20 | 3 | — | 1 | B.BET |
| 21 | — | 1 | — | B |
| 22 | — | — | — | Y |

FIG. 5

| | C | FIRST REEL | SECOND REEL | THIRD REEL | FOURTH REEL |
|---|---|---|---|---|---|
| 21 | 1 | 7 | 7 | 7 | 777 |
| | 2 | — | — | — | B.BET |
| 22 | 3 | 1 | 1 | 3 | R |
| | 4 | — | — | — | Y |
| | 5 | — | 1 | — | B.BET |
| 23 | 6 | 1 | — | 1 | R |
| | 7 | — | 5 | — | Y |
| 24 | 8 | 1 | — | — | B.BET |
| | 9 | — | — | 7 | R |
| | 10 | — | 3 | — | Y |
| | 11 | 3 | — | 1 | B.BET |
| | 12 | — | — | — | Y |
| | 13 | 5 | 5 | 1 | G |
| | 14 | — | — | — | B.BET |
| | 15 | 1 | 3 | — | B |
| | 16 | — | — | 5 | G |
| | 17 | — | — | — | B.BET |
| | 18 | 1 | 1 | 1 | B |
| | 19 | — | — | — | G |
| | 20 | 3 | — | 1 | B.BET |
| | 21 | — | 1 | — | B |
| | 22 | — | — | — | Y |

FIG. 6

| | COMBINATION OF FIRST-THIRD REEL | NUMBER OF COINS BETTED n | | |
|---|---|---|---|---|
| | | 1 COIN | 2COINS | 3COINS |
| 21 | ■ ■ ■ | ×3 | ×7 | ×7 |
| 22 | □ □ □ | ×2 | ×3 | ×4 |
| 23 | □ □ □ | ×2 | ×3 | ×4 |
| 24 | ⬚ ⬚ ⬚ | ×5 | ×5 | ×5 |

FIG. 7

| FOURTH REEL | BONUS POINT (2) |
|---|---|
| 777 | ×7 |
| R | ×2 |
| G | ×2 |
| B | ×2 |
| Y | ×2 |

ELECTRONIC GAMING MACHINE

BACKGROUND OF THE INVENTION

1. Field of the Invention

The present invention relates to an electronic gaming machine such as a slot machine, in which after betting playing mediums such as tokens and executing a game, the number of playing mediums is determined in response to the result of game.

2. Description of the Prior Art

A conventional slot machine includes a plurality of reels rotate all at once to start a game when the player operates a start lever after inserting one or more tokens. Each of the reels stops automatically after a fixed time has elapsed or stops sequentially by the operation of a stop button switch by the player, and one of the symbols printed on a peripheral surface of the reels stop on a predetermined stop line, whereby a combination of symbols is generated. When this combination of symbols coincides with one of several kinds of predetermined symbol combinations a predetermined number of tokens are paid.

In the conventional slot machine, however, the importance of the game is attached to whether or not the predetermined combination of symbols is established. Thus the number of tokens to be paid is responsive to the combination mode of the symbols in a one to one, fixed relation to predetermined combinations. Information about the operation and how the number of tokens to be paid is determined is not given to the player. Accordingly, a problem is that the content of game is simple, the game is not so interesting and there is little expectation on the number of tokens to be paid.

SUMMARY OF THE INVENTION

It is an object of the present invention to provide an electronic gaming machine, in which the content of the game is complicated to make it more interesting, and further, by informing the player of the process and the result of operations related to the number of tokens to be paid, expectations on the number of playing mediums such as the tokens to be paid is largely enhanced.

The electronic gaming machine of the present invention is constituted such that, after the playing mediums such as tokens are inserted and a game is executed, the number of playing mediums to be paid is determined in response to the result of game. The apparatus comprises, a plurality of movable bodies, a drive unit, a symbol detecting unit and an operation unit.

On the movable bodies, numerical and non-numerical symbols are indicated together. The drive unit drives the movable bodies separately, and stops the movable bodies such that either of the symbols stops at a predetermined stop position. The symbol detecting unit detects the kind of symbols stopped at the stop position and the content of the numerical value for respective movable bodies. The operation unit, when all the symbols of the movable bodies detected by the symbol detecting unit are those associated with the numerical values, executes the operation by substituting the numerical values into a predetermined operational equation to determine the number of gaming mediums to be paid in response to the operation result.

In a second invention, in addition to the configuration of the above-mentioned first invention, an operation display unit and a display control unit are included.

In the operation display unit, an operational equation having numerical substitution units corresponding to the number of movable bodies is displayed, and at the same time, numerical value displays are provided on the numerical substitution units. The display control unit displays the corresponding numerical values on the responsive numerical display of the operation display unit for the symbols of the movable bodies detected by the symbol detecting unit.

In the electronic gaming machine of the present invention, the numerical symbols and the non-numerical symbols are indicated together on the plural movable bodies and after driving and stopping the movable bodies separately by the drive unit, the kind of symbols stopped at a predetermined stop position and the content of the numerical values are detected by the symbol detecting unit for the respective movable bodies. When all of the symbols of the movable bodies detected are those associated with the numerical values, the operation is executed by substituting the numerical values into a predetermined operational equation to determine the number of playing mediums to be paid in response to the operation result, so that the number of playing mediums to be paid changes diversely, responsive to the numerical values of the symbols on the movable bodies which have stopped at the stop position.

In the second invention, since the numerical values corresponding to the symbols of the movable bodies which have stopped at a predetermined stop position are displayed on the operation display unit, the operation process for the number of playing mediums to be paid is disclosed to the player.

By the above-mentioned configuration, it is very effective in achieving the object of the invention to make the game more interesting and to largely enhance expectation for the number of playing mediums such as the tokens to be paid.

BRIEF DESCRIPTION OF THE DRAWINGS

FIG. 5 is an explanatory view showing symbols of the reels.

FIG. 6 is an explanatory view showing a first bonus point.

FIG. 7 is an explanatory view showing a second bonus point.

DESCRIPTION OF THE PREFERRED EMBODIMENTS

Figure 1:
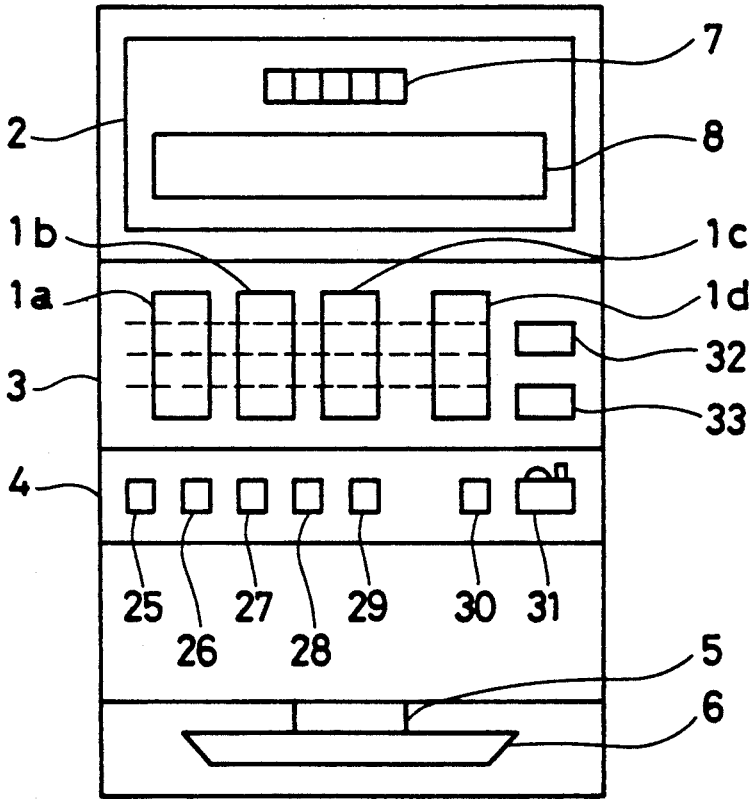
FIG. 1 is a front view showing an appearance of an electronic gaming machine according to one embodiment of the present invention.

FIG. 1 shows an appearance of an electronic gaming machine according to one embodiment of the present invention.

Though the electronic gaming machine shown is of a type, in which after rotating four reels 1*a* to 1*d* all at once, each of the reels 1*a* to 1*d* is automatically stopped sequentially after elapse of a predetermined time, the present invention is not limited thereto but can also be applied to a type, in which the reels 1*a* to 1*d* are stopped manually by a stop button switch.

In the electronic gaming machine shown, though it is constructed so that the reels 1*a* to 1*d* rotate mechanically, it may be of a type in which pictures of the reels are indicate on the screens for rotation.

Furthermore, in the electronic gaming machine shown, though a so-called credit system is employed, whereby a number of tokens are inserted into and deposited in the machine in advance, and the tokens thus deposited are spent by operating a push button to be described later to play the game, it is not limited thereto but can also be applied to a type such as a conventional slot machine, in which plural tokens are inserted for every game.

The electronic gaming machine includes an information display unit 2 at its upper position, and a reel display unit 3 and a button operation unit 4 are provided thereunder. At a lower position thereof a token discharge port 5 and a token receiver 6 are disposed.

Figure 2:
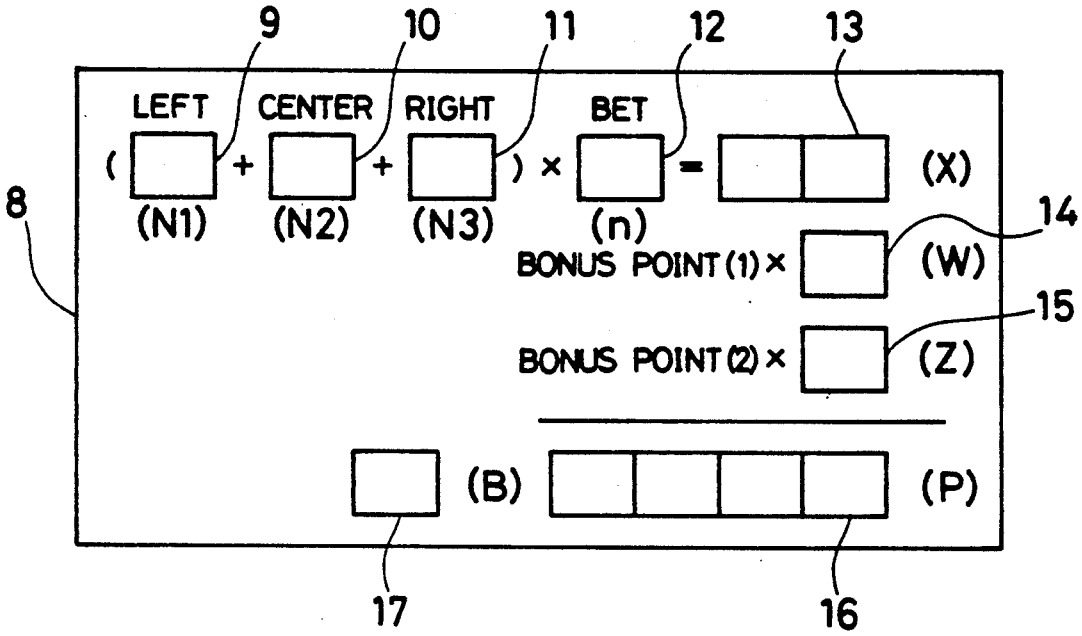
FIG. 2 is a front view showing a configuration of an operation value display.

In the information display unit 2, a store value display 7 which displays the deposit number of tokens in a numerical value, and an operation value display 8 which displays the number of tokens to be paid in a numerical value together with its operational equation are provided. The operation value display 8 is constituted such that, as shown in FIG. 2, the operational equation is printed in characters and black portions respectively in numerical value displays 9 to 17.

Among these numerical value displays, on the first three numerical value displays 9 to 11 on the first line, the numerical data N1, N2, N3 are displayed when symbols associated with the numerical values of the reels stop on a stop line, on the next numerical value display 12 the number of tokens n which has been bet is displayed and on the numerical value display 13 the intermediate operation result X is displayed. On the numerical value display 14 on the second line, a first bonus point W is displayed, on the numerical value display 15 on the third line, a second bonus point Z is displayed, and on the numerical value display 16 on the fourth line, the final operation result P obtained by multiplying the intermediate operation result X by the first and second bonus points W, Z is displayed. On the other numerical value display 17 on the fourth line, to be particularly described later, the number B of tokens to be paid when the game ends in a draw is displayed.

Figure 3:
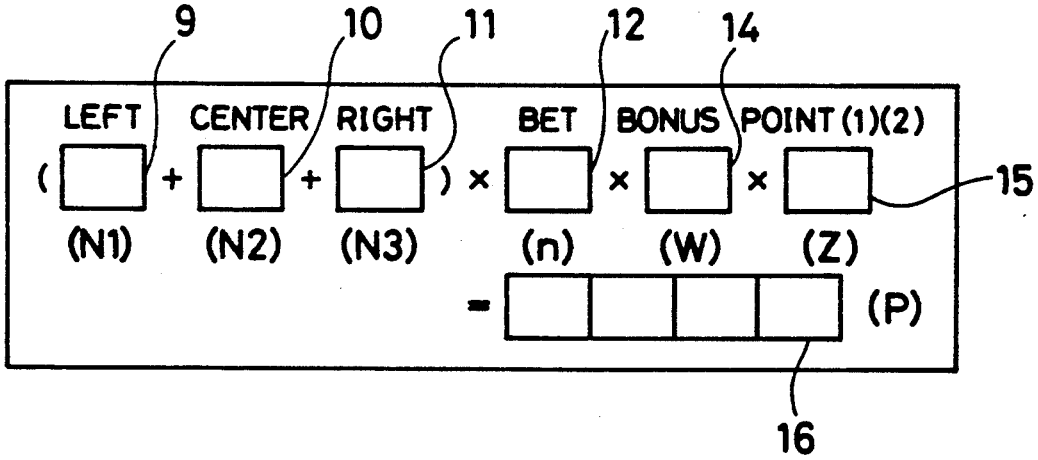
FIG. 3 is a front view showing another embodiment of an operation value display.

In another embodiment, though the intermediate operation result X is displayed, as shown in FIG. 3, in the blank portions provided in a series of operational equations, there may be provided numerical value displays 9, 10, 11 displaying the numerical data N1, N2, N3, the numerical value display 12 displaying the number h of tokens which has been bet, the numerical value displays 14, 15 displaying the first and second bonus points W, Z and the numerical value display 16 displaying a series of operation results P.

Also, in this embodiment, though an operational equation in which addition and multiplication are combined or an equation $P=(N1+N2+N3)\times n\times W\times Z$ is used, it is not limited thereto. For example, there may be an operational equation in which subtraction and division are combined or an operational equation other than four arithmetical operations may be used.

Figure 4:
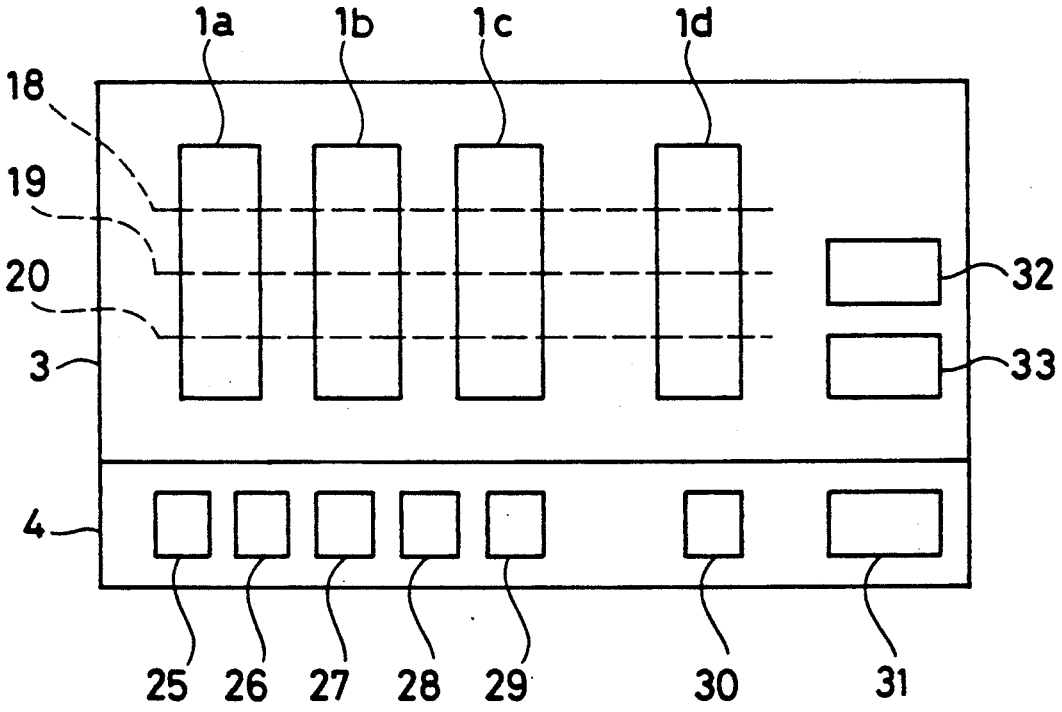
FIG. 4 is a front view showing a configuration of a reel display unit and a button operation unit.

FIG. 4 shows the enlarged reel display unit 3 and button operation unit 4.

The reel display unit 3 is the portion where the rotating states of the four reels 1*a* to 1*d* arranged at corresponding positions in the machine, and particularly 3 symbols out of 22 symbols printed around the reels can be seen through transparent plates when the reels come to a standstill. Three stop lines 18 to 20 are indicated on the transparent plates corresponding to the stop positions of the symbols.

FIG. 5 shows count values C of a counter unit 58 to be described later and the symbols printed around the reels 1*a* to 1*d*, which are corresponded with each other.

On the first to third reels 1*a* to 1*d*, the numerical symbols "1", "3", "5", "7" associated with the numerical value, and a non-numerical symbol (hereinafter referred to as "a first symbol") are indicated together in an equivalent array. The numerical symbols are surrounded by different kinds of frame lines to form a second symbol. In the case of this embodiment, the frame line 21 constituted by double lines is indicated in red, the frame line 22 constituted by a thick solid line is indicated in green, the frame line 23 constituted by a thick solid line is indicated in blue and the frame line 24 constituted by a dotted line is indicated in yellow.

The second symbols indicated in the frame lines 21 to 24 are associated with setting the first bonus point W. Thus as shown in FIG. 6, when three second symbols indicated in the frame line 21 are aligned on an effective stop line and when the number n of tokens which has been bet is one, a value of 3 times is given as the first bonus point W, and when n is two or three, a value of 7 times is given. Similarly, for the second symbols indicated in the frame lines 22, 23, the values of 2 times, 3 times and 4 times are given for n=1, 2, 3, respectively, and for the second symbol indicated in the frame line 24, the values of 5 times, 5 times and 5 times are given for n=1, 2, 3, respectively.

Around the fourth reel 1*d*, six kinds of third symbols "777", "R", "G", "B", "Y"and "B. BET" are printed. Respective symbols of the fourth reel 1*d* are associated with setting the second bonus point Z. Thus, as shown in FIG. 7 in a state where three of the first numerical symbols are aligned on an effective stop line, and when the third symbol "777" stops on the stop line, as shown in FIG. 7, a value of 7 times is given as the second bonus point Z. In a state where three of the second symbols indicated in the frame line 21 are aligned on the stop line, and when the third symbol "R" stops on the stop line a value of 2 times is given as the second bonus point Z. In a state where three of the second symbols indicated in the other frame lines 22, 23, 24 are aligned on an effective stop line, and when the corresponding third symbols "G", "B", "Y" stop on the line, a value of 2 times is given respectively as the second bonus point Z. In a state where three of the first non-numerical symbols "—" are aligned on an effective stop line, and when the third symbol "B. BET" stops on the stop line, the game ends in a draw and the number n of tokens which has been bet is paid back.

Referring again to FIG. 4, the button operation unit 4 is constituted by a plurality of push button switches and the like. Besides including a select switch 25, an auto. switch 26,.a max. betting operation switch 27, a betting operation switch 28, a start switch 29 and a clear switch 30, a token inserting hole 31 is provided.

The token inserting hole 31 is a portion into which a number of tokens are inserted continuously before starting a game. The select switch 25 is for selecting either of the three stop lines 18 to 20 and making it effective. The effective stop line is switched sequentially by every pressing operation.

The auto. switch 26 is for executing the betting operation of the tokens and the starting of reels at a stroke. Thus when the auto. switch 26 is pressed the number n of tokens to be bet is set to a maximum value (in this case 3 tokens), and three reels 1*a*, 1*b*, 1*c*, are started all at once. The max. betting operation switch 27 is for setting the number n of tokens to be bet to a maximum value (in this case 3 tokens), and the betting operation switch 28 is for setting the number n of tokens to be bet to a desired value (in this case 1 to 3 tokens).

When the betting operation switch 28 is pressed once, the number n of tokens to be bet is set to "1", when pressed twice it is set to "2" and when pressed three times it is set to "3", whereupon the player presses the auto. switch 26 to start the game. Alternatively, the player presses the start switch 29 after pressing the max. betting operation switch 27 or the betting operation switch 28 to start the game.

The clear switch 30 is used for clearing the tokens when the game is finished. When the clear switch 30 is pressed, the tokens deposited in the machine are cleared and the competent number of tokens are discharged to the token receiver 6 from the metal discharge port 5.

In FIGS. 1 and 4, numeral 32 designates a payment display for displaying the number of tokens to be paid in a numerical value, and numeral 33 designates a store value display for displaying the number of tokens deposited in the machine in a numerical value. The store value display 33 and the store value display 7 of the information display unit 2 have their display values updated by insertion of the tokens into the token inserting hole 31 or payment of the tokens during the game.

Figure 8:
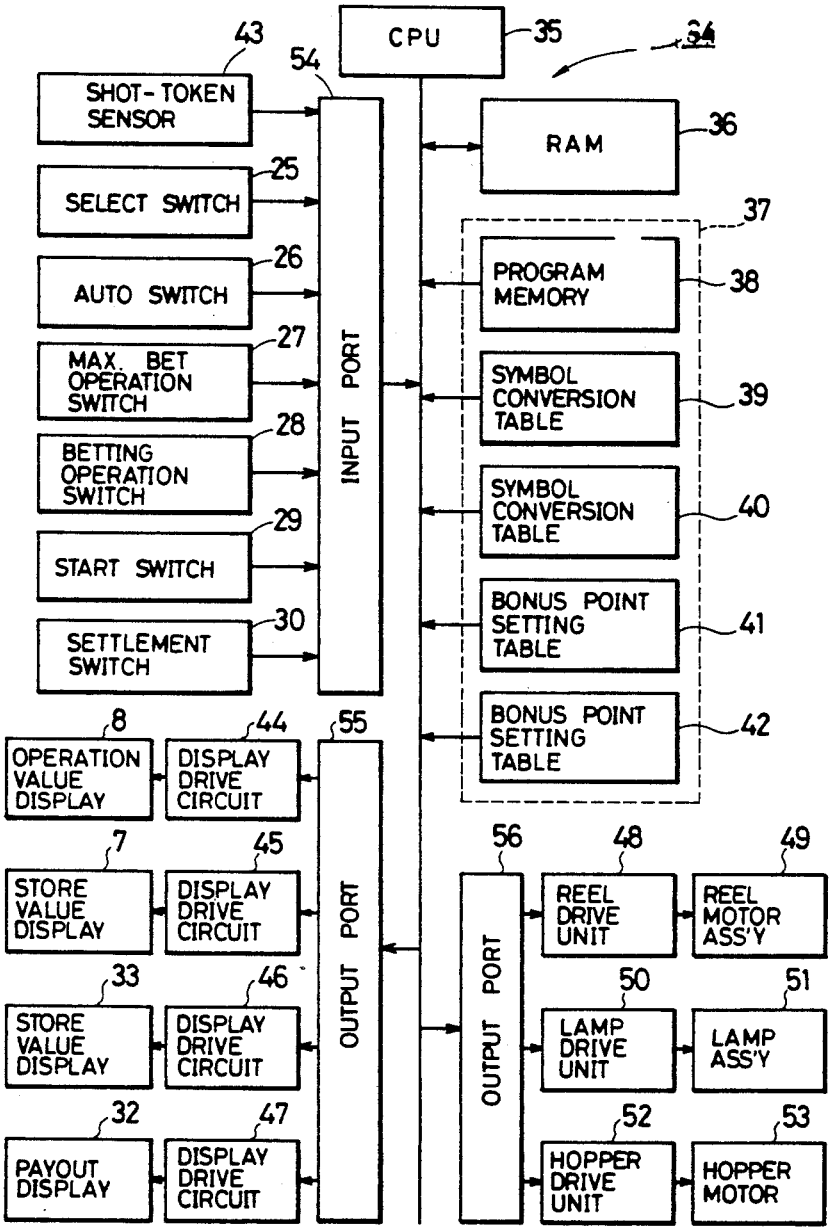
FIG. 8 is a block diagram showing an example of circuit configuration of an electronic gaming machine.

FIG. 8 shows an electrical configuration of the electronic gaming machine having the above-mentioned configuration.

In the figure, numeral 34 designates a control unit which is constituted by a CPU 35, a RAM 36, a ROM 37, an input port 54 and output ports 55, 56. The CPU 35 is a main control and operation unit, whereby the operation of input and output units are controlled in series via the input port 54 and the output ports 55, 56 while writing and reading data for the RAM 36 according to the programs.

Figure 9:
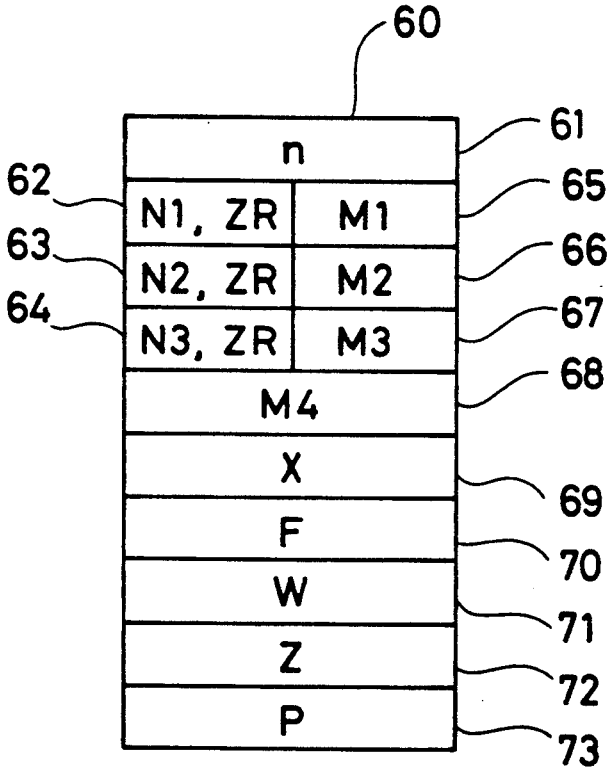
FIG. 9 is an explanatory view showing the content of the work area of a RAM.

FIG. 9 shows the content of a work area 60 included in the RAM 36. A plurality of areas 62 to 73 for storing data which are necessary for executing the game are set in the work area 60.

In the area 61 the number n of tokens which has been bet is stored, in the areas 62 to 64 data N1 to N3 or ZR which specify the first symbol of the first to third reels 1*a*, 1*b*, 1*c* stopped on an effective stop line are stored, in the areas 65 to 67 illustration data M1 to M3 which specify the second symbol are stored, and in the area 68 illustration data M4 which specifies the third symbol of the fourth reel 1*d* stopped on an effective stop line is stored. The above-mentioned reference characters N1, N2, N3 designate numerical data and ZR designates data other than the numerical value.

Meanwhile, in the area 69 the aforementioned intermediate operation result X is stored, in the area 70 a flag F to be described later is stored, in the area 71 the first bonus point W is stored, in the area 72 the second bonus point Z is stored and in the area 73 the final operation result P is stored.

Referring again to FIG. 8, the ROM 37 includes a program memory 38, two symbol conversion tables 39, 40 and two bonus point setting tables 41, 42, and in the program memory 38 programs indicating the operating sequences of the machine are stored.

One symbol conversion table 39 converts count values of the counter unit 58 of the CPU 35 to be described later into symbols of the first to third reels 1*a*, 1*b*, 1*c*, and the other symbol conversion table 40 converts count values of the counter unit 58 into symbols of the fourth reel 1*d*.

One bonus point setting table 41 is for obtaining the first bonus point W from a combination of the symbols of the first to third reels la, 1*b*, 1*c* aligned on an effective stop line, and specifically, a table having the content shown in FIG. 6 is set. The other bonus point setting table 42 is for obtaining the second bonus point Z from the symbols of the fourth reel 1*d* stopped on an effective stop line, and specifically, a table having the content shown in FIG. 7 is set.

A token insertion sensor 43 detects insertion of the tokens into the token inserting hole 31. Display drive circuits 44 to 47 respectively drive the operation value display 8, store value displays 7, 33 and the payment display 32 for digital display of the necessary numerical values. A reel drive unit 48 drives and stops a reel motor group 49 which drive the reels 1*a* to 1*d*, a lamp drive unit 50 lights a lamp group 51 provided everywhere on the machine and a hopper drive unit 52 drives a hopper motor 53 of a token discharger (not shown) for discharging tokens into the token discharge port 5.

Figure 10:
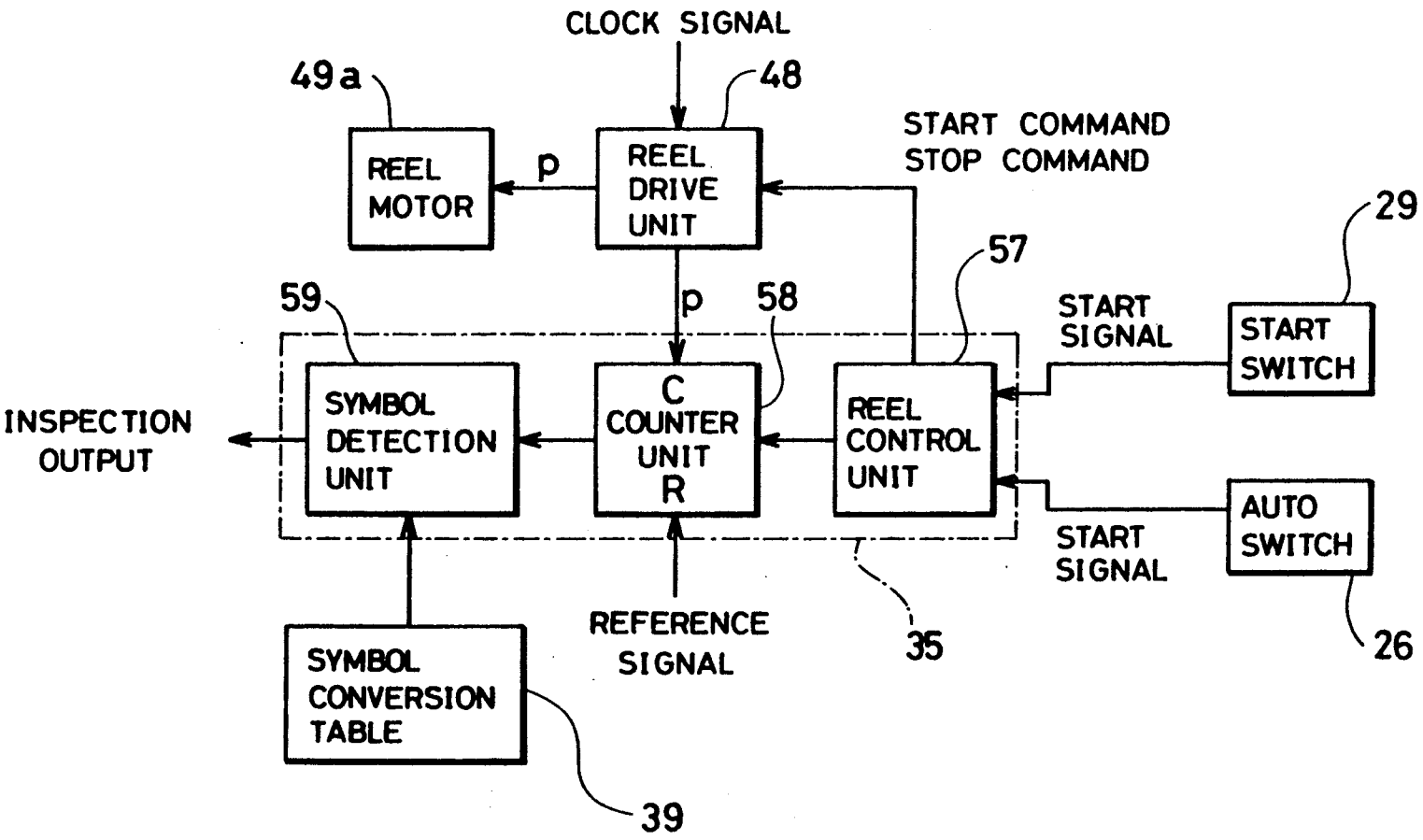
FIG. 10 is a block diagram showing a circuit configuration of a reel drive unit and functions of a CPU.

FIG. 10 shows a circuit configuration of the reel drive unit 48 and functions of the CPU 35. In the figure, though only the circuit configuration for the first reel 1*a* is shown, it is same for the second to fourth reels 1*b*, 1*c*, 1*d*, so that they are omitted.

In the figure, the reel drive unit 48 receives a clock signal and generates drive pulses p which are supplied to a reel motor 49*a* consisting of a stepping motor to drive the reel 1*a*. To the reel drive unit 48 a start command and a stop command are given from a reel control unit 57 of the CPU 35.

When the auto. switch 26 or the start switch 29 is pressed, a start signal is inputted to the reel control unit 57 which outputs the start command to operate the reel drive unit 48. When a timer included in the reel control unit 57 is started and a predetermined time has elapsed, the reel control unit 57 outputs the stop command to the reel drive unit 48 to stop the operation of the reel motor 49*a*.

The drive pulses p are given to a counter unit 58 of the CPU 35 and are counted therein. The count value of the counter unit 58 is reset by a reference signal given at every rotation of the reel 1*a*. A symbol detection unit 59 receives the count value of the counter unit 58, detects which symbol of the reel 1*a* has stopped on the effective stop line by referring to the symbol conversion table 39, and outputs the detected result which is written into the areas 62, 65.

Figure 11:
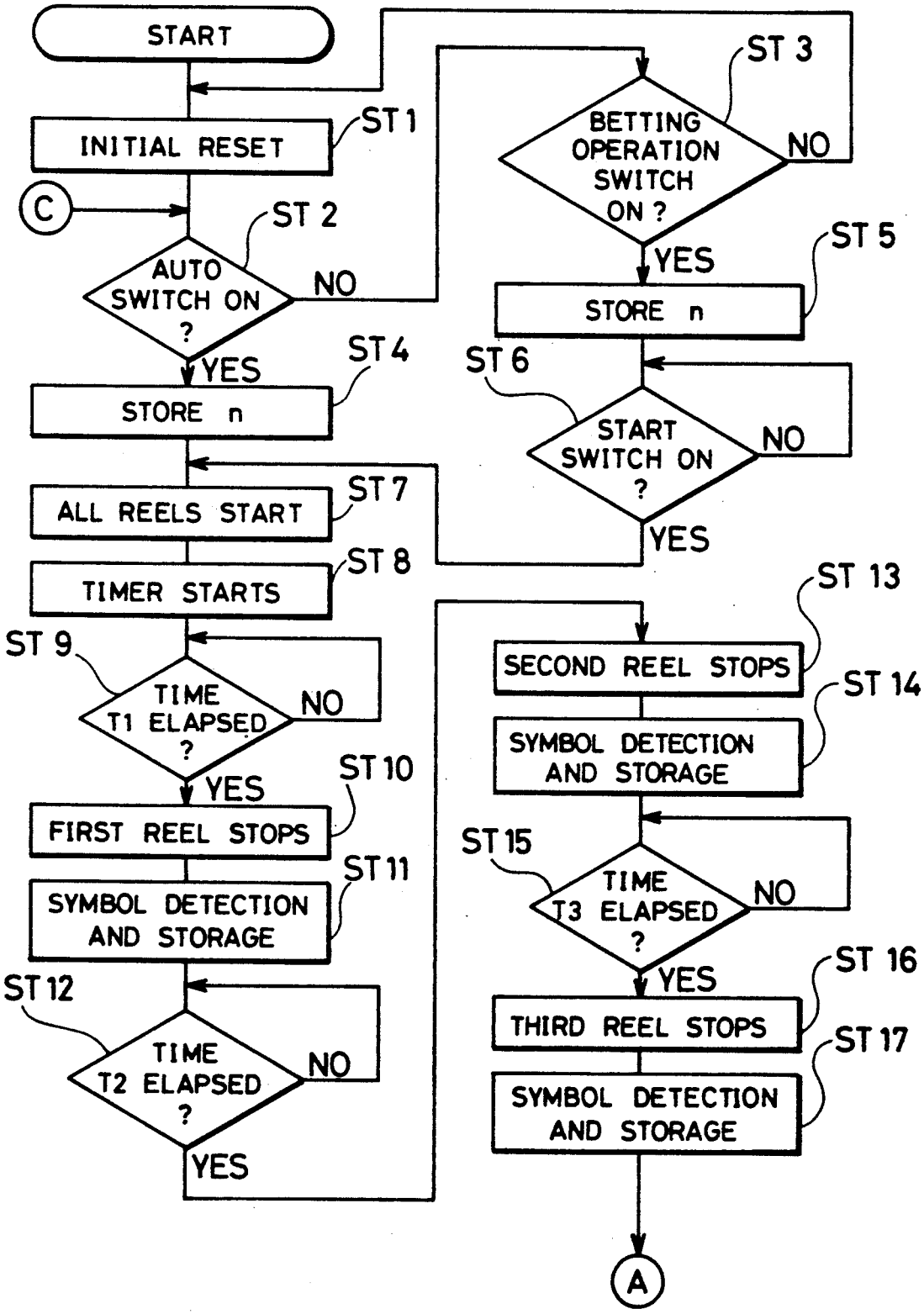
FIG. 11 is a flow chart showing a control sequence by a control unit.
Figure 12:
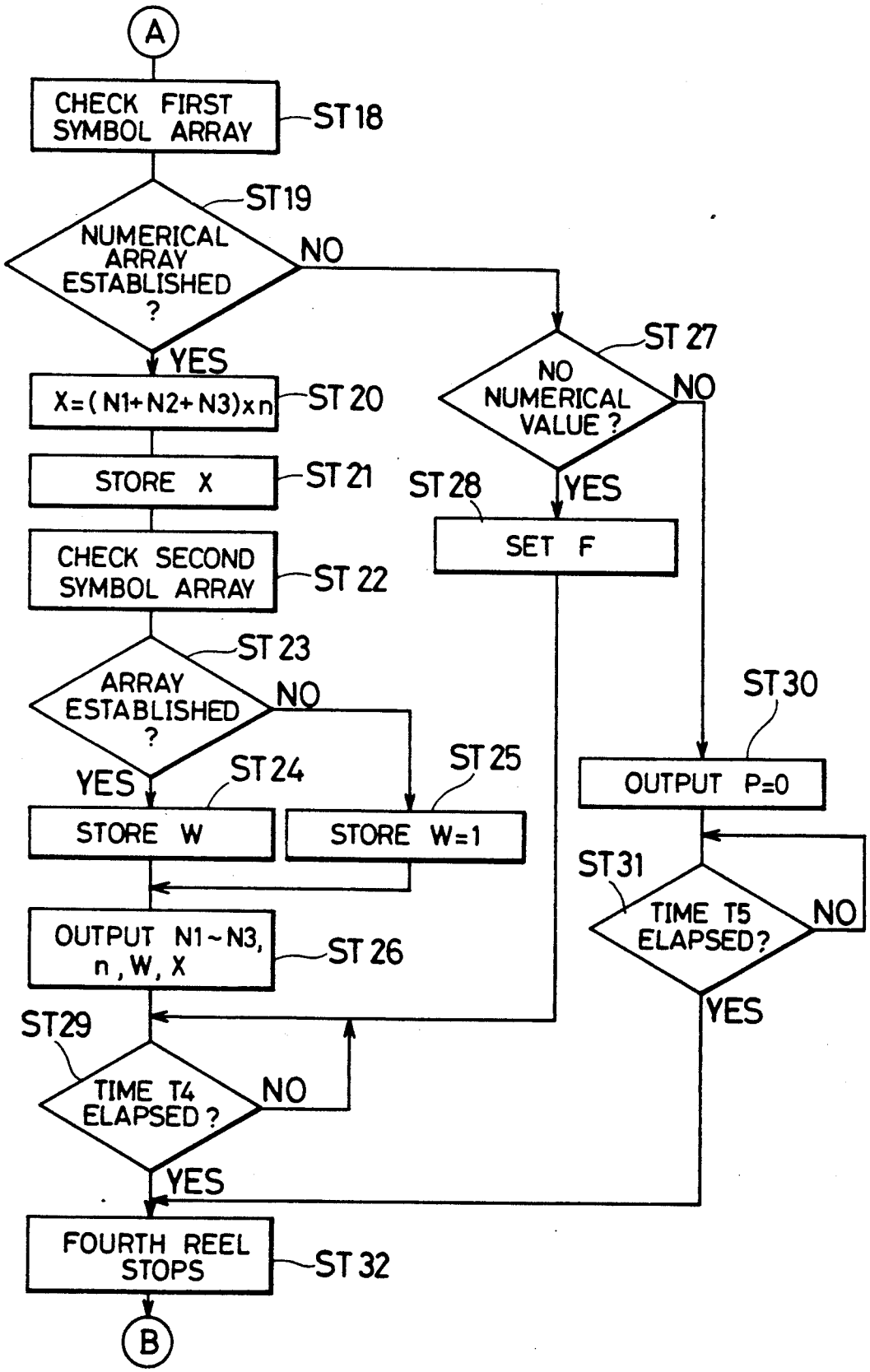
FIG. 12 is a flow chart showing a control sequence by a control unit.
Figure 13:
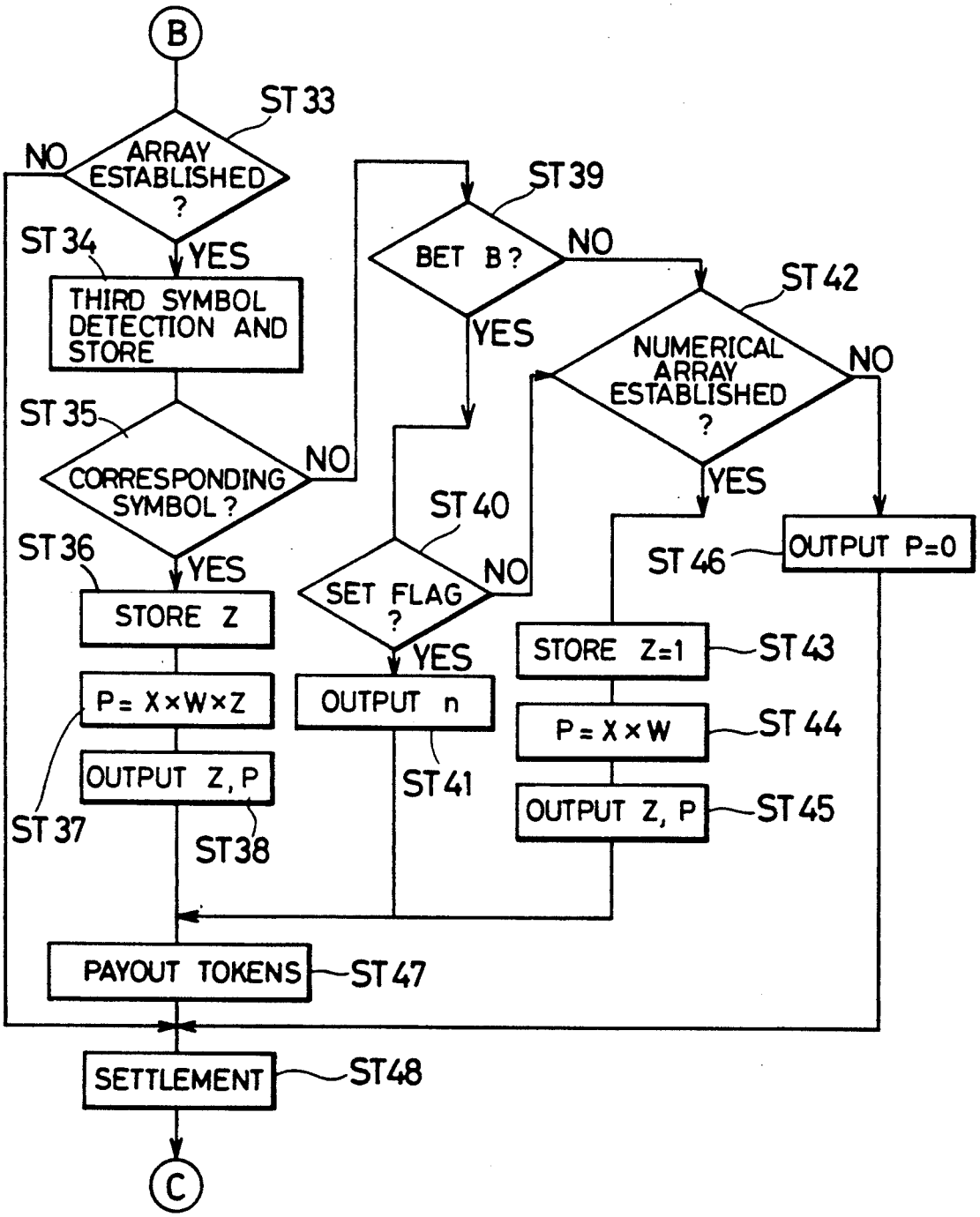
FIG. 13 is a flow chart showing a control sequence by a control unit.

FIG. 11 to FIG. 13 show control sequences by the control unit 34 in Step 1 (shown as "ST1" in the figure) to Step 48. In the following, the operation of the electronic gaming machine is described according to the figures.

First, after initializing and resetting respective portions of the control unit 34 at the beginning, in the next Steps 2, 3 it is judged whether either of the auto. switch 26, betting operation switch 28 and max. betting switch 27 is operated.

When the auto. switch 26 is pressed, it is judged "YES" in Step 2, and in Step 4 the CPU 35 sets the maximum number n (=3) of tokens in the area 61 of the RAM 36.

When the betting operation switch 28 or the max. betting operation switch 27 is pressed, it is judged "YES" in Step 3, and in Step 5 the CPU 35 sets the number of tokens which has been bet or the maximum number n of tokens in the area 61 of the RAM 36, and in the next Step 6 stands by for the pressing operation of the start switch 29.

When the start switch 29 is pressed in Step 6 or the auto. switch 26 is pressed in Step 2, four reels 1*a* to 1*d* start to rotate all at once and the timer included in the reel control unit 57 is started (Steps 7, 8).

When a predetermined time T1 has elapsed after starting the timer, it is judged "YES" in Step 9 and the first reel 1*a* stops in Step 10. In the next Step 11, the CPU 35 detects whether any symbols of the first reel 1*a* stop on an effective stop line, and for the first symbol, stores numerical data N1 or data ZR other than the numerical value in the area 62 of the RAM 36, and for the second symbol, stores illustration data Ml in the area 65.

When a predetermined time T2 has elapsed after starting the timer, it is judged "YES" in Step 12 and the second reel 1*b* stops in Step 13. In the next Step 14, the CPU 35 detects whether any symbols of the second reel 1*b* stop on an effective stop line, and for the first symbol, stores numerical data N2 or data ZR other than the numerical value in the area 63 of the RAM 36, and for the second symbol, stores illustration data M2 in the area 66.

Next, when a predetermined time T3 has elapsed after starting the timer, it is judged "YES" in Step 15 and the third reel 1*c* stops in Step 16. In the next Step 17, the CPU 35 detects whether any symbols of the third reel 1*c* stop on an effective stop line, and for the first symbol, stores numerical data N3 or data ZR other than the numerical value in the area 64 of the RAM 36, and for the second symbol, stores illustration data M3 in the area 67.

In the next Step 18, the CPU 35 checks the first symbol array aligned on the stop line by referring to the areas 62, 63, 64 of the RAM 36, and when three symbols associated with the numerical value have aligned, the player wins the game and it is judged "YES" in Step 19. In the next Step 20, the CPU 35 multiplies the sum of three numerical data N1, N2, N3 by the number n of tokens to obtain the intermediate operation result X, which is stored in the area 69 of the RAM 36 (Step 21).

In the next Step 22, the CPU 35 checks the second symbol array aligned on the stop line by referring to the areas 65, 66, 67 of the RAM 36, and when three second symbols indicated in the same frame line area are aligned, it is judged "YES" in Step 23, and in the next Step 24 the CPU 35 stores the first bonus point W which corresponds to the array in the area 71 of the RAM 36.

In the case wherein three second symbols indicated in the different frame lines are aligned, it is judged "NO" in Step 23 and in Step 25, the CPU 35 stores "1" in the area 71 of the RAM 36 as the first bonus point W.

Next, the CPU 35 reads the numerical data N1 to N3, the number n of tokens, the intermediate operation result X and the first bonus point W from the areas of the RAM 36, and outputs to a display drive circuit 44 to display the numerical values corresponding to the responsive numerical displays 9 to 14 of the operation value display 8 (Step 26).

Meanwhile, when three first symbols (—) not associated with the numerical value are aligned on the stop line, it is judged "NO" in Step 19 and "YES" in Step 27, and then the CPU 35 proceeds to Step 28 and sets the flag F in the area 70 of the RAM 36.

Next, when a predetermined time T4 has elapsed after starting the timer, it is judged "YES" in Step 29 and the CPU 35 proceeds to Step 32, stops the fourth reel 1*d* and moves to the third symbol detecting sequence.

Meanwhile, when the first numerical symbol and the first non-numerical symbol "—" are aligned together on the stop line, the player loses the game and it is judged "NO" both in Steps 19, 27. Accordingly, in step 30, the CPU 35 outputs "0" to the display drive circuit 44 as the final operation result P to display a numerical value "0" on the numerical display 16. In this case, it is judged "YES" in Step 31 at the time point when a predetermined time T5 which is shorter than the time T4 has elapsed, and the fourth reel 1*d* is stopped (Step 32).

In the next Step 33, it is checked whether three first numerical symbols are aligned, or three first non-numerical symbols "—" are aligned, and when it is judged "NO" or the player loses the game, the CPU 35 proceeds to Step 48 to clear the content of the work are 60 of the RAM 36.

When it is judged "YES" in Step 33, the CPU 35 detects whether any third symbols of the fourth reel have stopped on the stop line, and stores the illustration data M4 in the area 68 (Step 34).

In the next Step 35, the CPU 35 judges whether the third symbol stopped on the stop line is "777" or corresponds to the three second symbols aligned on the stop line, and when it is judged "YES" in Step 35, the second bonus point Z corresponding to the third symbol is given and stored in the area 72 of the RAM 36 (Step 36).

Next, the CPU 35 multiplies the intermediate operation result X by the first and second bonus points W, Z to obtain the final operation result P which is stored in the area 73 of the RAM 36. Thereafter reads the second bonus point Z and the final operation result P from the areas of the RAM 36 to output to the display drive circuit 44, and then displays the numerical values corresponding to the responsive numerical displays 15, 16 of the operation value display 8 (Steps 37, 38).

Meanwhile, when the third symbol stopped on the stop line is not "777" and does not correspond to three second symbols aligned on the stop line, it is judged "NO" in Step 35 and in the next Step 39, the CPU 35 judges whether the third symbol is "B. BET". When it is judged "YES", in the next Step 40 it is judged whether the flag F is set already. When it is judged "YES" the game is ended in a draw and in Step 41, the CPU 35 reads the number n of tokens from the area 61 of the RAM 36 and outputs to the display drive circuit 44 to display the numerical value on the numerical display 17 of the operation value display 8 (Step 41).

In case it is judged "NO" in Step 39 or Step 40, the CPU 35 proceeds to Step 42 and judges whether three first numerical symbols or three first non-numerical symbols "0" are aligned on the stop line. When it is judged "YES" in Step 42, the CPU 35 stores "1" in the area 72 of the RAM 36 as the second bonus point Z (Step 43).

Then, the CPU 35 multiplies the intermediate operation result X by the first bonus point W to obtain the final operation value P, which is stored in the area 73 of the RAM 36. Thereafter CPU 35 reads the second bonus point Z and the final operation result P from the areas of the RAM 36, and outputs to the display drive circuit 44 to display the corresponding numerical values on the responsive numerical displays 15, 16 of the operation value display 8 (Steps 44, 45).

When it is judged "NO" in Step 42, three first non-numerical symbols "—" are aligned on the stop line and the third symbols other than "B. BET" of the fourth reel 1*d* have stopped. In this in this case the player loses the game and the CPU 35 outputs "0" to the display drive circuit 44 as the final operation result P and displays on the numerical display 16, and thereafter clears the content of the work area 60 of the RAM 36 in Step 48.

In Step 47, the CPU 35 pays the tokens corresponding to the operation result P when the player wins the game, and after instructing a hopper drive unit 52 to pay back the tokens corresponding to the number n of tokens at a draw game, clears the content of the work area 60 of the RAM 36 in Step 48.

Figure 14:
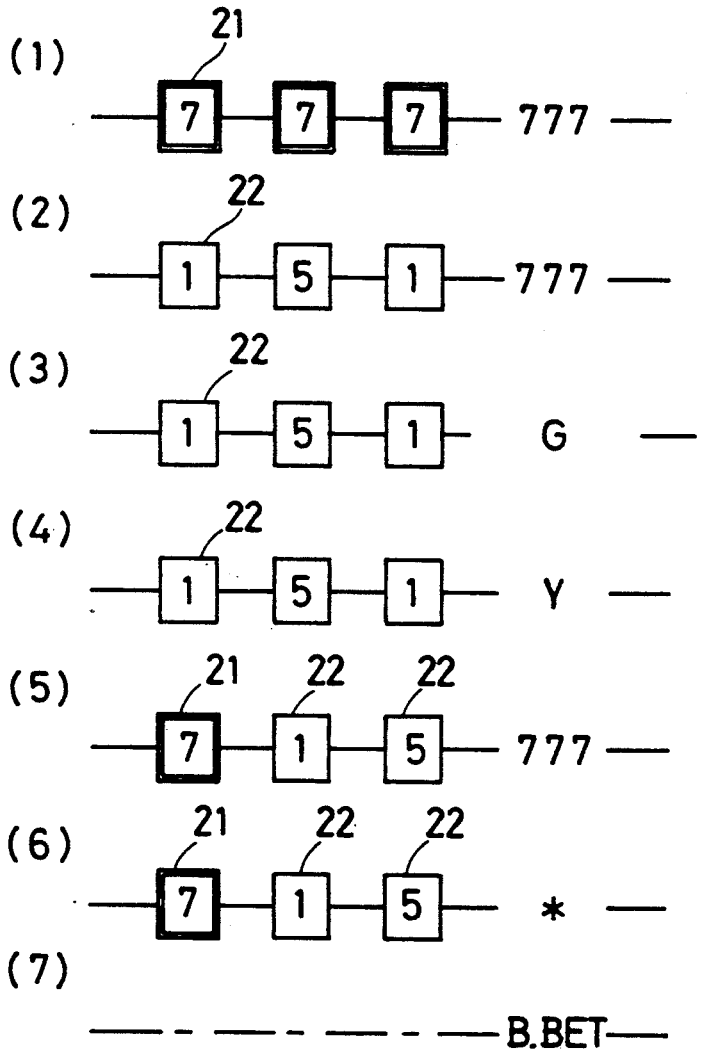
FIG. 14 is an explanatory view showing symbol combinations of the first to fourth reels aligned on a stop line.

FIGS. 14 (1) to (7) show combinations of the symbols of the first to fourth reels 1*a* to 1*d* aligned on the stop line, wherein FIGS. 14 (1) to (6) show the case of a winning game and FIG. 14 (7) shows the case of a drawn game.

FIG. 15 to FIG. 21 show examples of display of the operation value display 8 when the symbol combinations shown in FIG. 14 (1) to (7) are established.

In FIG. 14 (1), three numerical values "7" as the first symbol and three illustrations indicated in the frame line 21 as the second symbol are aligned on the stop line, and "777" is standing still as the third symbol.

Figure 15:
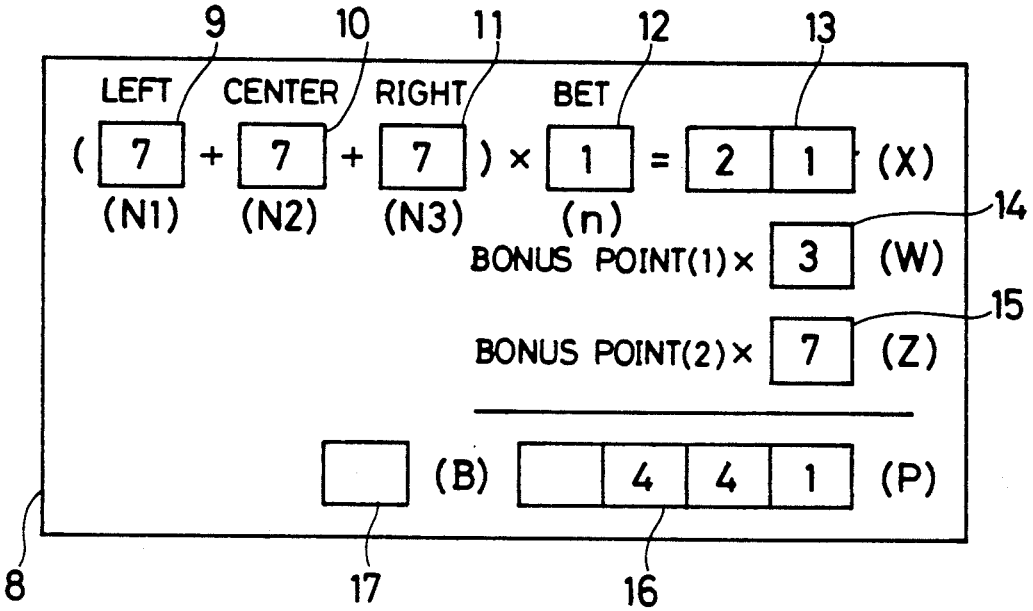
FIG. 15 is an explanatory view showing an example of an operation value display corresponding to FIG. 14 (1).

In case the number n of tokens which has been bet is "1", as shown in FIG. 15, N1=N2=N3=7 and the intermediate operation result X is $(7+7+7)\times 1=21$. Since the first bonus point W is "3" and the second bonus point Z is "7", the final operation result is $21\times 3\times 7=441$.

In FIG. 14 (2), numerical values "1", "5", "1", as first symbols and three illustrations indicated in the frame line 22 as the second symbols are aligned on the stop line, and "777" is standing still as the third symbol.

Figure 16:
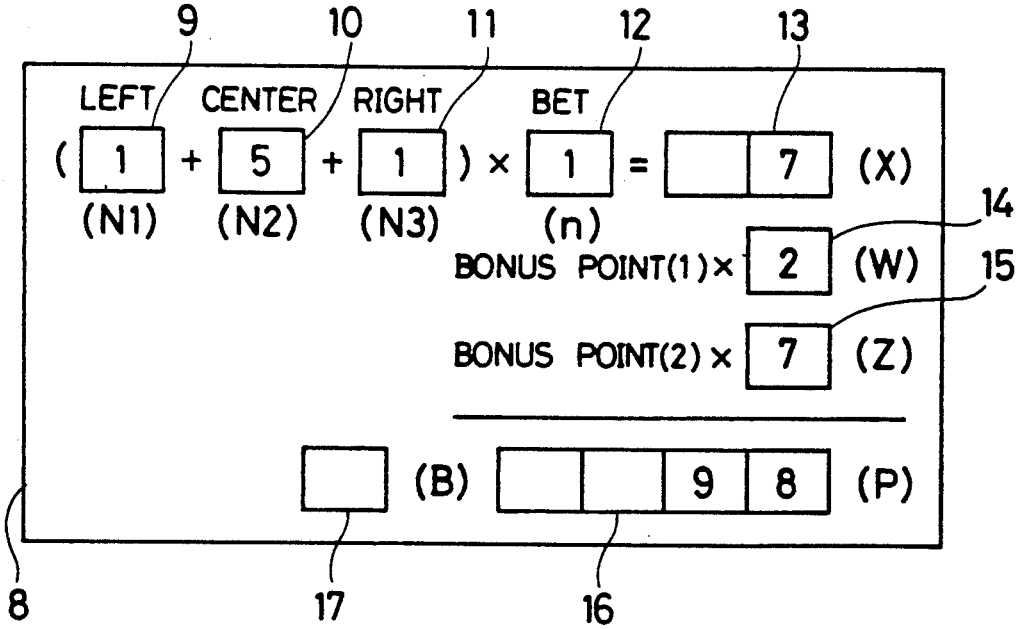
FIG. 16 is an explanatory view showing an example of an operation value display corresponding to FIG. 14 (2).

In case the number n of tokens which has been bet is "1", as shown in FIG. 16, N1=1, N2=5 and N3=1 and the intermediate operation result X is $(1+5+1)\times 1=7$. Since the first bonus point W is "2" and the second bonus point Z is "7", the final operation result P is $7\times 2\times 7=98$.

In FIG. 14 (3), numerical values "1", "5", "1"as the first symbols and three illustrations indicated in the frame line 22 as the second symbols are aligned on the stop line, and "G" is standing still as the third symbol.

Figure 17:
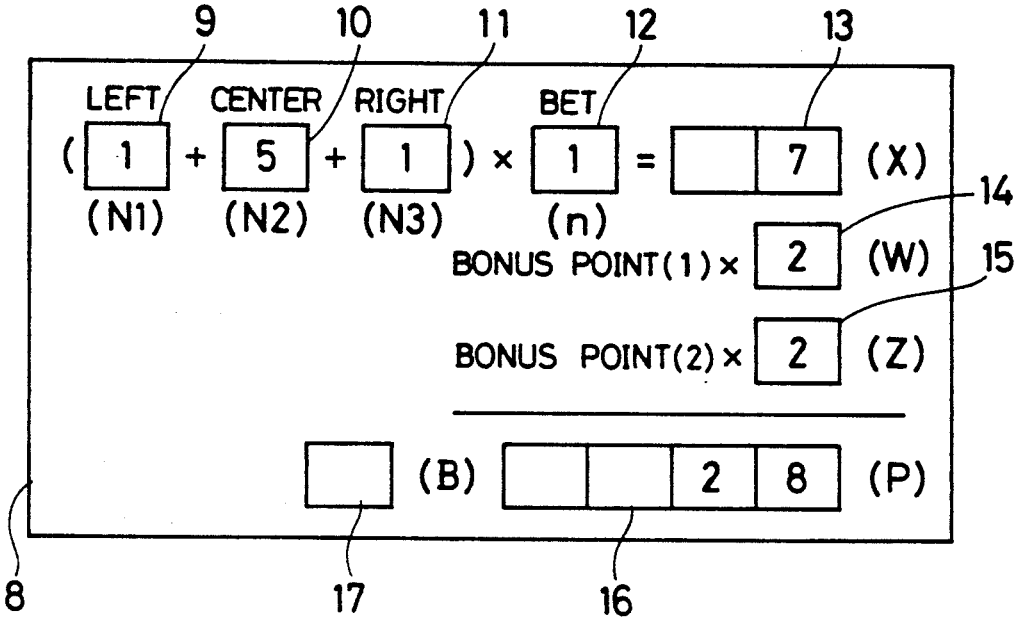
FIG. 17 is an explanatory view showing an example of an operation value display corresponding to FIG. 14 (3).

In case the number n of tokens which has been bet is "1", as shown in FIG. 17, N1=1, N2=5 and N3=1 and the intermediate operation result X is $(1+5+1)\times 1=7$. Since the first bonus point W is "2" and the second bonus point Z is "2", the final operation result P is $7\times 2\times 2=28$.

In FIG. 14 (4), numerical values "1", "5", "1" as the first symbols and three illustrations indicated in the frame line 22 as the second symbols are aligned on the stop line, and "Y" is standing still as the third symbol.

Figure 18:
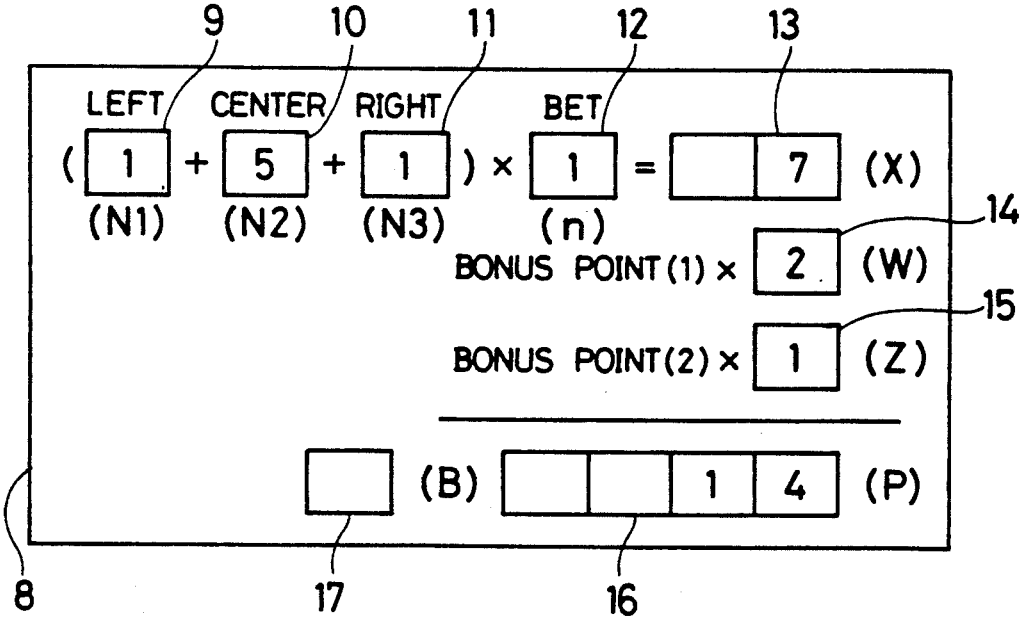
FIG. 18 is an explanatory view showing an example of an operation value display corresponding to FIG. 14 (4).

In case the number of tokens which has been bet is "1", as shown in FIG. 18, N1=1, N2=5, N3=1 and the intermediate operation result X is $(1+5+1)\times 1=7$. Since the first bonus point W is "2" and the second bonus point Z is "1", the final operation result P is $7\times 2\times 1=14$.

In FIG. 14 (5), numerical values "7", "1", "5" as the first symbols and three illustrations indicated in the frame lines 21, 22 as the second symbols are aligned on the stop line, and "777" is standing still as the third symbol.

Figure 19:
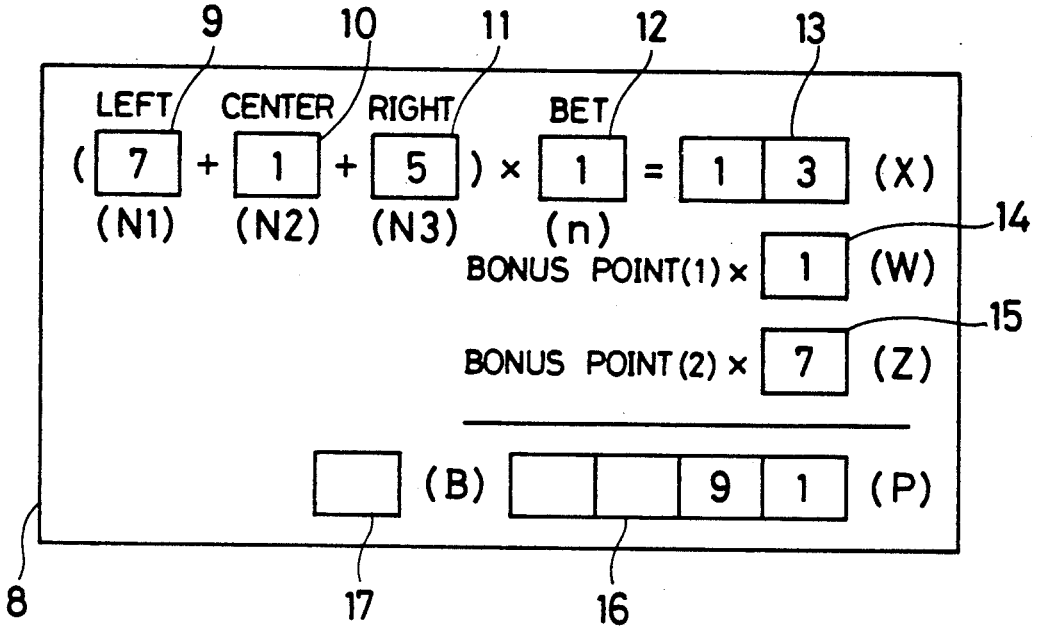
FIG. 19 is an explanatory view showing an example of display of an operation value display corresponding to FIG. 14 (5).

In case the number n tokens which has been bet is "1", as shown in FIG. 19, N1=7, N2=1 and N3=5 and the intermediate operation result X is $(7+1+5)\times 1=13$. Since the first bonus point W is "1" and the second bonus point Z is "7", the final operation result P is $13\times 1\times 7=91$.

In FIG. 14 (6), numerical values "7", "1", "5" as the first symbols and three illustrations indicated in the frame lines 21, 22 as the second symbols are aligned on the stop line, and an optional illustration * is standing still as the third symbol.

Figure 20:
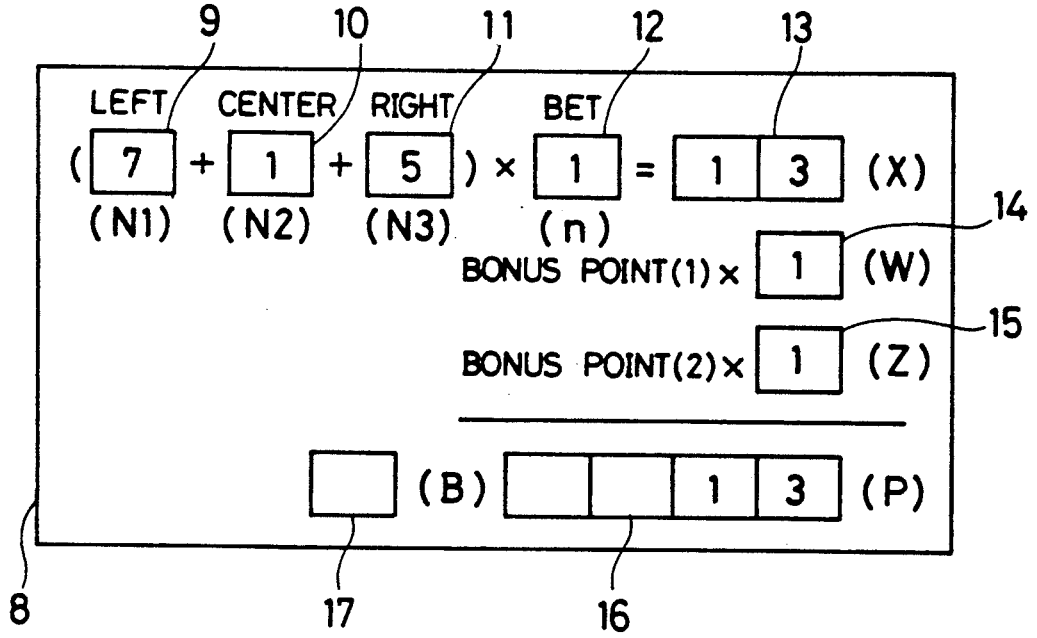
FIG. 20 is an explanatory view showing an example of an operation value display corresponding to FIG. 14 (6).

In case the number n of tokens which has been bet is "1", as shown in FIG. 20, N1=7, N2=1 and N3=5 and the intermediate operation result X is $(7+1+5)\times 1=13$. Since the first bonus point W is "1" and the second bonus point Z is "1", the final operation result P is $13\times 1\times 1=13$.

Figure 21:
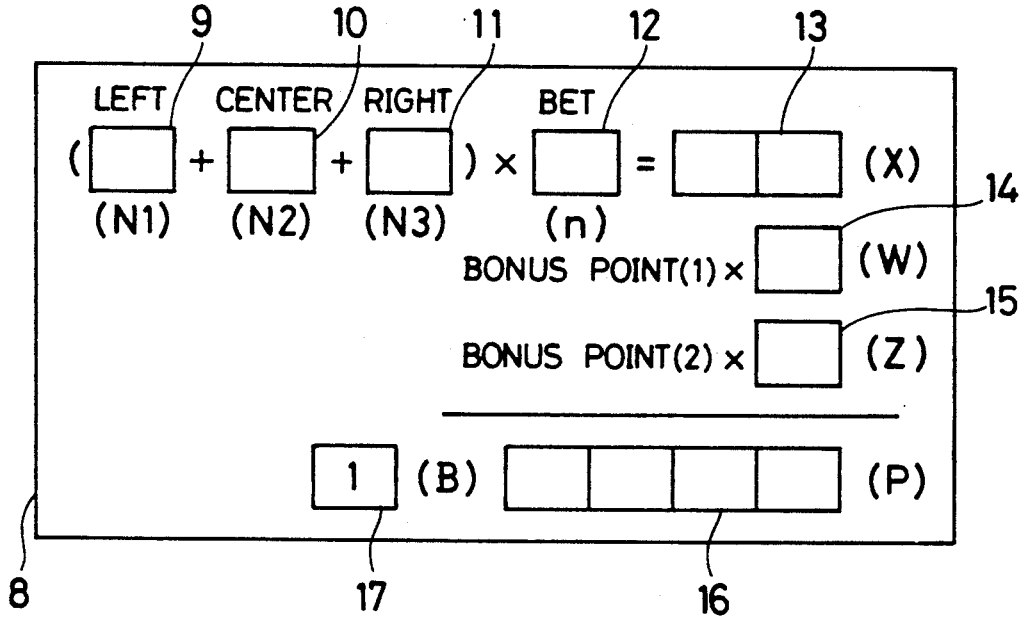
FIG. 21 is an explanatory view showing an example of an operation value display corresponding to FIG. 14 (7).

In FIG. 14 (7), three non-numerical symbols "—" are aligned as the first symbols on the stop line, and "B. BET" as the third symbol is standing still. In case the number n of tokens which has been bet is "1", as shown in FIG. 21, the number B of tokens to be paid is "1".

What is claimed is:

1. An electronic gaming machine, in which after a game has been executed by betting playing mediums, the number of playing mediums to be paid is determined in response to a result of the game, said electronic gaming machine comprising:

a plurality of movable bodies containing numerical symbols and non-numerical symbols together thereon;

drive means for separately driving and stopping the movable bodies such that one of the symbols on each movable body stops at a predetermined stop position;

symbol detecting means for detecting the types of symbols on the movable bodies stopped at the stop position and the numerical value of any numerical symbols of the movable bodies stopped at the stop position; and operation means for substituting the detected numerical values into a predetermined operational equation and for performing an operation in response thereto to produce an operation result, when the symbols of the movable bodies detected by the symbol detecting means are all numerical symbols having numerical values, to thereby determine the number of playing mediums to be paid in response to the operation result.

2. An electronic gaming machine in accordance with claim 1, wherein said electronic gaming machine further includes an operation display means for displaying an operational equation having a number of numerical substitution units corresponding to the number of movable bodies, with numerical displays being provided on the numerical substitution units; and display control means for controlling said operation display means to display corresponding numerical values on the numerical display means for symbols of the movable bodies detected by the symbol detecting means.

3. An electronic gaming machine according to claim 1, wherein there are three said movable bodies containing said numerical symbols and said non-numerical symbols together thereon.

4. An electronic gaming machine according to claim 1, wherein said movable bodies include different borders surrounding said numerical symbols, with said numerical and non-numerical symbols constituting a first type of symbol and said different borders constituting a second type of symbol.

5. An electronic gaming machine according to claim 4, wherein said operation means further assigns a mathematical factor to the operation result in response to said second types of symbols associated with the numerical symbols stopped at the stop position.

6. An electronic gaming machine according to claim 5, further including a fourth movable body containing different indicia thereon, said different indicia constituting a third type of symbol.

7. An electronic gaming machine according to claim 6, wherein said operation means further assigns an additional mathematical factor to the operation result in response to the third type of symbol associated with the numerical symbols stopped at the stop position.

8. An electronic gaming machine according to claim 1, wherein said operation means includes central processing means for performing said operation, ROM means for storing an operational program used by said central processing means and RAM means for providing a storage area for said operation result.

* * * * *